US010532395B2

(12) United States Patent
Grüneklee et al.

(10) Patent No.: US 10,532,395 B2
(45) Date of Patent: Jan. 14, 2020

(54) METHOD AND DEVICE FOR PRODUCING SHAPED SHEET METAL PARTS AT A LOW TEMPERATURE

(71) Applicants: Axel Grüneklee, Duisburg (DE); Markus Zörnack, Dortmund (DE); Thomas Heller, Duisburg (DE); Ekaterina Bocharova, Mülheim an der Ruhr (DE); Seyed Amin Mousavi Rizi, Frechen (DE)

(72) Inventors: Axel Grüneklee, Duisburg (DE); Markus Zörnack, Dortmund (DE); Thomas Heller, Duisburg (DE); Ekaterina Bocharova, Mülheim an der Ruhr (DE); Seyed Amin Mousavi Rizi, Frechen (DE)

(73) Assignees: ThyssenKrupp Steel Europe AG, Duisburg (DE); Outokumpu Nirosta GmbH, Krefeld (DE)

( * ) Notice: Subject to any disclaimer, the term of this patent is extended or adjusted under 35 U.S.C. 154(b) by 902 days.

(21) Appl. No.: 14/554,206

(22) Filed: Nov. 26, 2014

(65) Prior Publication Data

US 2015/0082636 A1 Mar. 26, 2015

Related U.S. Application Data

(63) Continuation of application No. PCT/EP2013/060934, filed on May 28, 2013.

(30) Foreign Application Priority Data

May 31, 2012 (DE) ..... 10 2012 104 734

(51) Int. Cl.

| | |
|---|---|
| ***B21J 1/00*** | (2006.01) |
| ***B21J 1/06*** | (2006.01) |
| ***B21K 7/12*** | (2006.01) |

(52) U.S. Cl.
CPC . *B21J 1/06* (2013.01); *B21J 1/00* (2013.01); *B21K 7/12* (2013.01); *Y10T 29/49622* (2015.01)

(58) Field of Classification Search
CPC ... B21J 1/06; B21K 7/12; B21D 37/16; B21D 22/02; Y10T 29/49622
See application file for complete search history.

(56) References Cited

U.S. PATENT DOCUMENTS 3,469,972 A * 9/1969 Flaherty ..... B21D 53/645 148/325
3,972,744 A 8/1976 Cantrell
(Continued)

FOREIGN PATENT DOCUMENTS

CN 2680680 Y 2/2005
CN 101280352 A 10/2008
(Continued)

*Primary Examiner* — Rick K Chang
(74) *Attorney, Agent, or Firm* — Reinhart Boerner Van Deuren P.C.

(57) ABSTRACT

The invention relates to a method for producing a shaped sheet-metal part from a panel or a semifinished part made of a material consisting of steel with at least 60 wt. % Fe and a residual austenite content of at least 5%, in which the panel or the semifinished part is at least partially cooled to a temperature below −20° C. before the shaping and is shaped at a temperature below −20° C. in a forming tool. The object of providing a method for producing load-compliantly configured components, which on the one hand permits industrial-scale use of low-temperature forming and is configured particularly simply, is achieved by reducing the material temperature of the panel or semifinished part to below −20° C. is carried out in a thermally regulated cooling apparatus.

20 Claims, 3 Drawing Sheets

(56) References Cited

U.S. PATENT DOCUMENTS

| | | | | |
|---|---|---|---|---|
| 2012/0014626 | A1 | 1/2012 | Watanabe et al. | |
| 2013/0125607 | A1* | 5/2013 | Samek ..... | B21D 22/02 72/364 |

FOREIGN PATENT DOCUMENTS

| | | | |
|---|---|---|---|
| DE | 10 2008 020 794 | A1 | 8/2009 |
| DE | 102009050623 | A1 | 5/2010 |
| DE | 102010012579 | B3 | 7/2011 |
| DE | 102011012240 | A1 | 11/2011 |
| EP | 1749593 | A2 | 2/2007 |
| EP | 1990109 | A1 | 11/2008 |
| EP | 2012948 | B1 | 9/2009 |
| EP | 2175041 | A1 | 4/2010 |
| EP | 2 287 344 | A1 | 2/2011 |
| EP | 1 779 871 | B1 | 6/2014 |
| JP | 48-31115 | | 4/1973 |
| JP | 55-040017 | A | 3/1980 |
| JP | 06-154894 | A | 6/1994 |
| JP | 08108233 | A | 4/1996 |
| JP | 08-150421 | A | 6/1996 |
| JP | 2000178640 | A | 6/2000 |
| JP | 2007-111765 | A | 5/2007 |
| JP | 2007-144488 | A | 6/2007 |
| JP | 2011-518669 | A | 6/2011 |
| WO | WO 2006/038868 | A1 | 4/2006 |

* cited by examiner

METHOD AND DEVICE FOR PRODUCING SHAPED SHEET METAL PARTS AT A LOW TEMPERATURE

CROSS-REFERENCE TO RELATED PATENT APPLICATIONS

This patent application is a continuation of PCT/EP2013/060934, filed May 28, 2013, which claims priority to German Application No. 10 2012 104 734.0, filed May 31, 2012, the entire teachings and disclosure of which are incorporated herein by reference thereto.

BACKGROUND OF THE INVENTION

The invention relates to a method for producing a shaped sheet-metal part from a panel or a semifinished part made of a material consisting of steel with at least 60 wt. % Fe and a residual austenite content of at least 5%, in which the panel or the semifinished part is at least partially cooled to a temperature below −20° C. before the shaping and is shaped at a temperature below −20° C. in a forming tool. The invention furthermore relates to a device for carrying out the method and to an advantageous use of the sheet-metal parts produced.

In order to meet the increasing requirements to reduce weight, for example in motor vehicle manufacture, methods have been developed for producing shaped sheet-metal parts which, particularly under the term "hot forming", undergo a pressure-hardening process in order to achieve maximum strengths, i. e. yield points and tensile strengths, in the pressure-hardened component. In this way, the wall thickness of the sheet-metal part, and therefore the weight, can be minimised. In this case, the panel or the semifinished part must usually be heated to a temperature above the $AC_1$ transition temperature, so that the sheet-metal component essentially contains an austenitic structure, in order subsequently to be shaped at very high temperature and rapidly cooled. The effect achieved by this is that the austenitic structure is converted into martensite by the rapid cooling, so that very high tensile strengths and yield points can be provided. With manganese-boron steels, for example a manganese-boron steel of the type MBW1500, tensile strengths in the range of more than 1100 MPa can be provided by this method. The known hot-forming methods have furthermore been developed further so that the sheet-metal parts can also be locally provided with enormous yield points and tensile strengths, so that a load-compliant configuration of the sheet-metal parts can be achieved. The use of a "tailored blank", which requires additional cost-intensive working steps in the form of a joining step, for example using a laser beam, or a separate component, can thereby be avoided. Disadvantages of hot forming are, on the one hand, the enormous energy outlay which is required for heating the panels or the semifinished parts to above the $AC_1$ transition temperature, i. e. usually above 850° C. Furthermore, significant problems arise with surface coatings, which are required for example for corrosion protection. It is conventional to use hot-dip aluminised semifinished parts, or semifinished parts provided with an Al—Si coating, but these have no cathodic corrosion protection. Although surface coatings containing tin have cathodic corrosion protection, there is, however, the risk of melting the zinc on the surface during the heating. Uncoated semifinished parts are susceptible to scaling, if operation is not carried out in a protective gas.

The Japanese Patent Application JP 2000/178640 A, on the other hand, discloses a method in which the components are shaped at low temperature, and very high tensile strengths and yield points can thereby be achieved in the material by solidification. In the Japanese Patent Application, it is proposed to cool the components or at least partially using liquid oxygen, liquid nitrogen or dry ice, or in another way, and to shape them at temperatures of from −50° C. to −200° C. To this end, it is proposed to immerse the components in the corresponding refrigerants, in order to cool them very strongly. On the one hand, immersion of the sheet-metal shaped parts in liquid nitrogen or oxygen, or even dry ice, is not readily suitable for industrial-scale use. It furthermore entails risks for the operating personnel of corresponding plants, which lead to increased safety precautions.

SUMMARY OF THE INVENTION

It is therefore an object of the present invention to provide a method for producing load-compliantly configured components, which on the one hand permits industrial-scale use of low-temperature forming and is configured particularly simply.

According to the first teaching of the present invention, the aforementioned object is achieved in that reduction of the material temperature of the panel or the semifinished part to below −20° C. is carried out in a thermally regulated cooling apparatus.

In contrast to the known prior art, the panel or the semifinished part is thermally regulated in a thermally regulated cooling apparatus to a shaping temperature below −20° C., preferably to a temperature in the range of from −40° C. to −180° C. The low temperatures, in combination with shaping, lead for the residual austenite steel of the panel or the semifinished part to partial conversion of the austenite into martensite, so that a significant increase is achieved, above all for the yield point. The thermally regulated cooling apparatus furthermore makes it possible straightforwardly to reduce significantly the risk due to the use of liquid refrigerants cooled to low temperature, for example liquid oxygen, liquid nitrogen, or even liquid or solid carbon dioxide (dry ice), so that industrial-scale use of low temperature forming is made possible. In the context of the present patent application, thermally regulated cooling apparatuses are intended to mean devices in which the panels or the semifinished parts are positioned and brought to low temperature by using correspondingly cold refrigerants. To this end, it is not necessarily required for the panels or semifinished parts to be in direct contact with the refrigerant, for example liquid oxygen, nitrogen or carbon dioxide.

Preferably, according to a first configuration of the present invention, the panel or the semifinished part is removed from the cooling apparatus and delivered to the forming tool immediately before the shaping process. Removal of the panel or the semifinished part immediately before the shaping process makes it possible for the panel or the semifinished part to be kept as far as possible at the shaping temperature until the shaping, and to this extent for it to be at the desired temperature at least at the start of the shaping process.

Additionally to the use of the thermally regulated cooling apparatus, it is also possible to use a thermally regulated forming tool, so that the panel or semifinished part removed from the cooling apparatus can be kept at low temperature for as long as possible in the forming tool.

Furthermore, according to another configuration of the present invention, it is also possible to use the forming tool itself, in which the panel or the semifinished part is cooled and subsequently shaped, as the cooling apparatus. To this end, the forming tool comprises means for cooling the panel or for thermally regulating the regions in contact with the panel or the semifinished part, so that an optimal cooling process is achieved. A particular advantage of this configuration of the method according to the invention is that the panel or the semifinished part merely has to be introduced into a forming tool, and can be shaped therein without further removal or transport. In this way, maximum process control is achieved, since the shaping temperatures can be controlled straightforwardly by means of the forming tool.

According to a next configuration of the method according to the invention, the forming tool thermally regulates the panel to be shaped, or the semifinished part to be shaped, only in the regions in which a high yield point and tensile strength are required. This makes it possible for the regions of the shaped sheet-metal part which should have an increased strength, i. e. an increased tensile strength and/or yield point, due to the low-temperature forming, to be established merely by the configuration of the forming tool.

Since the temperatures of the forming tool are very low, the surfaces of the forming tool are susceptible to icing on contact with humid outside air. In this regard, according to another configuration of the method according to the invention, the process reliability may be further increased in that icing of the forming tool, and the panel and/or the semifinished part, is prevented by using deicing means before and during the shaping.

If the deicing is carried out by using mechanical deicing means, icing which is already present can be removed straightforwardly from the forming tool. Furthermore, in addition or as an alternative, it is furthermore possible to produce a protective gas atmosphere on the cooled regions of the forming tool, the panel or the semifinished part by using a protective gas, so that icing is prevented. The effect achieved by providing a protective gas atmosphere on the cooled regions of the panel or the forming tool is that no air humidity can condense or freeze at these positions and be deposited on the regions of the panel, the semifinished part or the forming tool. This measure may, for example, be combined with mechanical deicing means.

Preferably, the cooling of the forming tool, the panel and/or the semifinished part is carried out using a protective gas, the protective gas preferably flowing through flow channels, provided in the forming tool, into the corresponding regions to be cooled of the forming tool, the panel and/or the semifinished part.

In the method according to the invention, particularly small wall thicknesses of the panel or the semifinished part may furthermore be used. These are preferably from 0.5 mm to 1.80 mm, more preferably from 0.7 mm to 1.20 mm. In particular by using the thermally regulated forming tool, corresponding shaping of the panel or the semifinished part with these small thicknesses is particularly advantageous since they can be brought rapidly to low temperature in the forming tool and load-compliant shaped sheet-metal parts, which have significant strength increases on the more heavily loaded regions, can be produced with a relatively short cycle time.

Particularly preferably, a panel or a semifinished part which has a surface coating is shaped, a surface coating containing zinc optionally being used as the surface coating. The surface coating is not damaged during the low-temperature forming, so that cathodic corrosion protection can readily be employed by using a surface coating containing zinc, without its being detrimentally affected by the shaping. The sheet-metal part produced in this way has on the one hand load-compliant strength values, and is furthermore protected particularly well against corrosion by virtue of the surface coating. Besides a surface coating containing zinc, it is of course also readily possible to use an organic coating which can be shaped at the correspondingly low temperatures.

According to a second teaching of the present invention, the aforementioned object is achieved by a device for carrying out the method in that a forming tool, which comprises a recess for insertion of a panel or a semifinished part is provided, and means are provided for at least local cooling of the panel or the semifinished part to a temperature below −20° C. The device according to the invention makes it possible to cool the panel or the semifinished part to the shaping temperature in the forming tool, and to shape it without a further transport step. In this way, maximum economic viability is achieved, since it is no longer necessary to remove the panel or the semifinished part from the forming tool between the steps of thermal regulation and shaping.

Preferably, the forming tool comprises means for deicing the cooled regions of the forming tool, the panel or the semifinished part, in order to ensure continuous process-reliable operation. To this end, the means may comprise mechanical means such as brushes or scrapers, which can also remove icing which is already present.

According to another configuration of the device according to the invention, the forming tool comprises flow channels at least in the regions coming in contact with the panel or the semifinished part, through which a refrigerant for local cooling of the panel or the semifinished part flows. A water-free refrigerant, for example dry ice or liquid nitrogen, is preferably used as the refrigerant. For example, the flow channels may extend as far as the panel or the semifinished part, so that they can cool the corresponding regions of the panel placed in the forming tool, or the inserted semifinished part, to low temperatures, and a protective gas atmosphere which prevents icing of the regions is simultaneously formed. Furthermore, the flow channels may, however, only extend through the forming tool, so that no refrigerants, for example oxygen, nitrogen or carbon dioxide, emerge in the region of the forming tool.

According to another teaching of the present invention, the aforementioned object is achieved by the use of a sheet-metal part, which has been produced by a method according to the invention, as a structural part of a motor vehicle, the structural part comprising regions with different strengths. As already mentioned above, by the low-temperature forming it is likewise possible to achieve large strength differences in shaped sheet-metal parts. The increase in the yield point and the tensile strength is in this case achieved owing to the residual austenite content of the material by conversion of the residual austenite content into a martensitic structure. An increase in the strength increase can be achieved through selection of the low temperature, although it should be taken into account that the brittleness of the material increases with a decreasing temperature and the degree of shaping is therefore restricted.

Since furthermore, as already mentioned, a surface coating protecting against corrosion, in particular a coating containing zinc, does not suffer any damage in the method according to the invention, it is particularly advantageous to use the sheet-metal part as a pillar, support, large-area component, base plate, tunnel, end wall or wheel well of a motor vehicle. All the aforementioned sheet-metal parts are conventionally exposed to more or less strong corrosion attack in the motor vehicle, and therefore require a surface coating protecting against corrosion. Furthermore, load-compliantly configured sheet-metal parts, i. e. comprising regions with different strengths, offer the possibility of saving costs since it is not necessary to use expensive tailored blanks which consist of a plurality of metal sheets. The one-piece sheet-metal parts also do not have any strength-reducing weld bead. Furthermore, the component reduction and therefore cost reduction can also be achieved since separate reinforcements can be avoided.

According to another configuration of the use according to the invention, the sheet-metal part is used as an A-, B- or C-pillar of a motor vehicle, at least one region of the roof connection of the A-, B- or C-pillar having a higher strength than the region of the A-, B- or C-pillar base.

Lastly, another advantageous use is obtained when the sheet-metal part is used as a longitudinal beam in the front region of a motor vehicle, and the longitudinal beam comprises a front region which has a lower strength than the rear region. The front region of the longitudinal beam in the front region, with a lower strength, is meant to deform in the event of impact and to this extent absorb the impact energy. The rear region of the longitudinal beam, conversely, should as far as possible not undergo any deformation, and should therefore protect the passenger compartment.

It has previously been possible to produce corresponding solutions only by using patches, tailored blanks or additional reinforcing components. The use according to the invention of the sheet-metal part furthermore makes it possible to provide in a straightforward way a one-piece sheet-metal part which, besides very good cathodic corrosion protection, at the same time also allows simplified and economical production of a longitudinal beam with regions of different strengths.

BRIEF DESCRIPTION OF THE DRAWINGS

The invention will be explained in more detail below with the aid of exemplary embodiments in connection with the drawings.

DETAILED DESCRIPTION OF THE INVENTION

Figure 1:
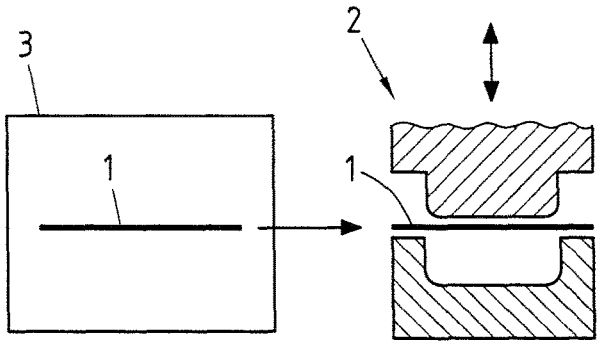
FIG. 1 shows an outline diagram of one exemplary embodiment of the method for producing a shaped sheet-metal part.

FIG. 1 first shows an outline diagram of the method for producing a shaped sheet-metal part, in which a panel 1 is intended to be shaped in a forming tool 2. The forming tool 2 is represented as a simple deep-drawing tool. However, the forming tool 2 represents any forming tools, such as are used for the production of shaped sheet-metal parts from flat panels or already preshaped or cut semifinished parts. The panel 1 consists of a steel containing at least 60 wt. % Fe and a residual austenite content of at least 5%. Typical examples of these steel types are, for example, high-manganese steels or alternatively TRIP steels. In the case of these steels, particularly the residual austenite steels (TRIP steels), it is observed that during shaping at very low temperatures austenitic regions are partially converted into a martensitic structure, and a further yield point and strength increase is therefore achieved in addition to the work hardening. It has been found that this effect increases significantly at temperatures lowered further, so that the strengthening process, which also represents a so-called TRIP effect in addition to the conventional work-hardening effect, can lead to very high yield points and tensile strengths. With a RA-K 40/70 steel (TRIP steel), for example, the yield point can be increased from 410 MPa to more than 800 MPa. In the exemplary embodiment of the method as represented in FIG. 1, the panel 1 is first cooled in a cooling apparatus 3 to a temperature below −20° C., preferably a temperature of from −40° C. to −190° C. To this end, refrigerants, for example liquid nitrogen, dry ice or liquid oxygen, may be used in the cooling apparatus without entailing a safety risk for operating personnel of the device. The thermally regulated cooling apparatus may for example comprise closed circuits of the correspondingly cold refrigerants, which transfer the cold for example by direct metal contact to the panel or the semifinished part. Once the panel, which has a wall thickness of preferably from 0.5 mm to 1.8 mm, particularly preferably from 0.70 mm to 1.20 mm, has reached the shaping temperature, it is removed from the cooling apparatus shortly before the shaping process and delivered to the forming tool. The shaping is then carried out immediately, so that the temperature rise due to removal from the cooling apparatus is limited. Preferably, the forming tool 2 itself may also be thermally regulated, so that a significant temperature rise of the panel in the forming tool is prevented.

Figure 2:
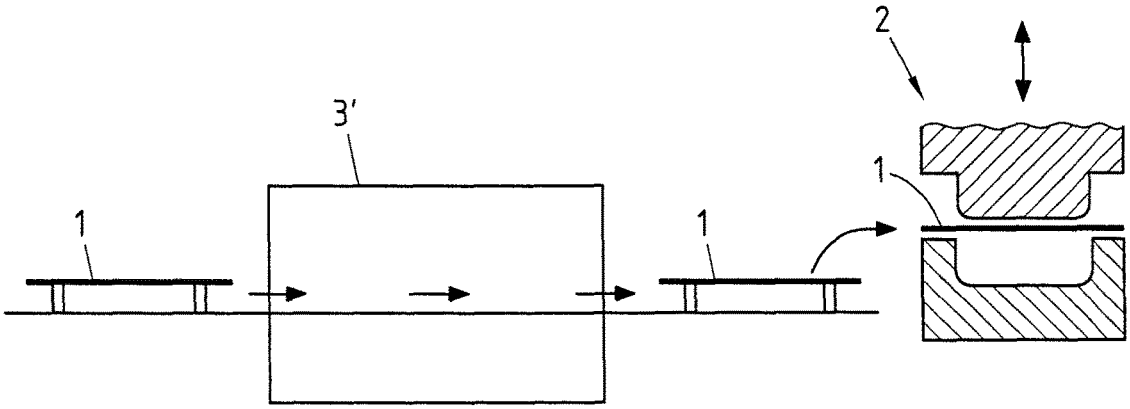
FIG. 2 is an alternative embodiment of the method represented in FIG. 1.

As can be seen from FIG. 1, the cooling apparatus 3 provides discontinuous operation of the cooling of the panel 1. In contrast thereto, the cooling apparatus 3' represented in FIG. 2 allows continuous passage of the panel 1 or the semifinished part 1 through the cooling apparatus 3', so that the panel 1 or the semifinished part 1 is brought to the shaping temperature at the exit of the cooling apparatus 3'. The panel 1 or the semifinished part 1 is then placed in the forming tool 2 immediately after leaving the cooling apparatus 3', and is shaped. As already mentioned above, the forming tool 2 is represented here merely generically as a deep-drawing tool. In principle, AHU/IHU [external high-pressure/internal high-pressure] forming tools and any other forming tools, which cause shaping and therefore strengthening in the sheet-metal part, are also suitable.

Figure 3A:
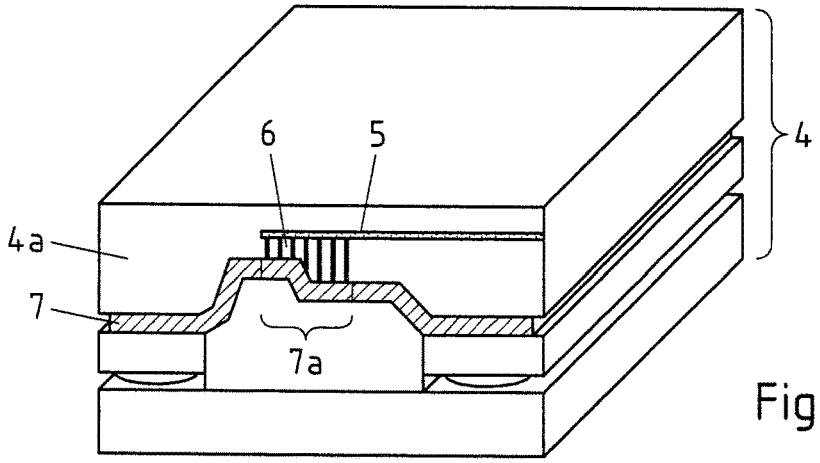
FIGS. 3*a*) and 3*b*) show one exemplary embodiment of a forming tool for carrying out the method.
Figure 3B:
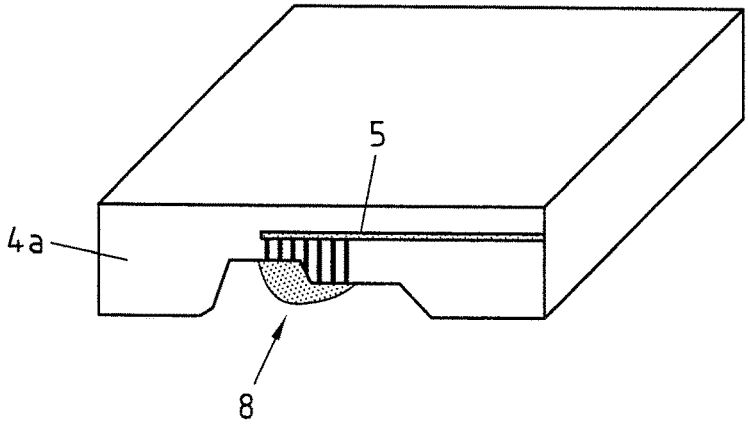

One optional configuration of the forming tool is represented in the schematic perspective view in FIGS. 3*a*), *b*). The forming tool 4 represented in FIG. 3*a*) comprises an upper forming tool half 4*a*, arranged in which there are flow channels 5 that generate a cooled region 6 of the panel, which is then shaped at low temperature. To this end a refrigerant, for example liquid nitrogen or liquid oxygen, or alternatively carbon dioxide cooled to low temperature, flows through the flow channels and thereby cools the panel strongly in this region.

During the shaping, very much greater strengthening by the TRIP effect takes place in the highly cooled regions than in uncooled regions, so that the sheet-metal part 7 produced comprises a region 7*a* which has much higher yield points and tensile strengths owing to the strong TRIP effect.

In order to prevent icing of the forming tool of FIG. 3*a*), it is advantageous that when the tool is opened, the upper tool half 4*a*, which comprises the flow channels and is therefore particularly cold, also carries the refrigerant through the flow channels while the tool is being opened. In this way, icing of the tool surfaces is prevented because a protective gas atmosphere 8 is formed in the region of the strongly cooled surfaces of the forming tool.

Figure 4:
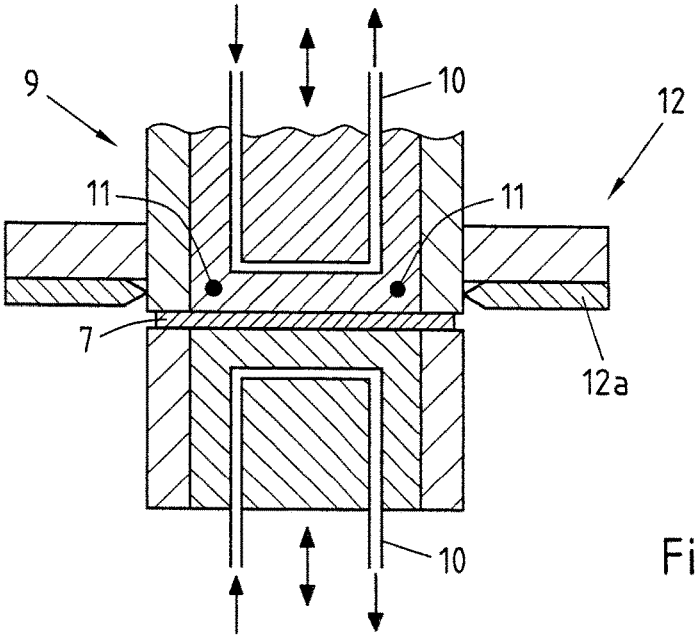
FIG. 4 is another exemplary embodiment of a forming tool for carrying out the method for producing a shaped sheet-metal part.

FIG. 4 in turn represents one exemplary embodiment of a forming tool, which comprises a closed circuit for the refrigerant. To this end, the schematically represented forming tool 9 comprises refrigerant channels 10 in the region of the stamp or die, through which a refrigerant regulated to a correspondingly low temperature flows. The panel 1, which is arranged between the two halves of the forming tool 9 and has flat contact therewith, is cooled very strongly in the region of the surfaces in contact with the cooled stamp, and is brought to a shaping temperature below −20° C. If there are possibly regions which are not meant to be brought to the corresponding temperature, means that additionally allow local heating of the panel 1 are provided in the stamp 11. These means may, for example, be configured as a heating cartridge or similar means releasing heat. Means for mechanical deicing are furthermore provided on the forming tool 9, and are represented schematically. The mechanical deicing means 12 consists of a holder for receiving a scraper 12*a*, which for example cleans the surface of the stamp 9' when the forming tool 9 is opened. It is also conceivable to use brushes instead of the scraper 12*a*. The forming tool 9 represented may in any event cool an inserted panel 1 to the shaping temperature below −20° C. in a relatively short time owing to the large-area contact, and therefore provide a simple and economical production process.

Figure 5:
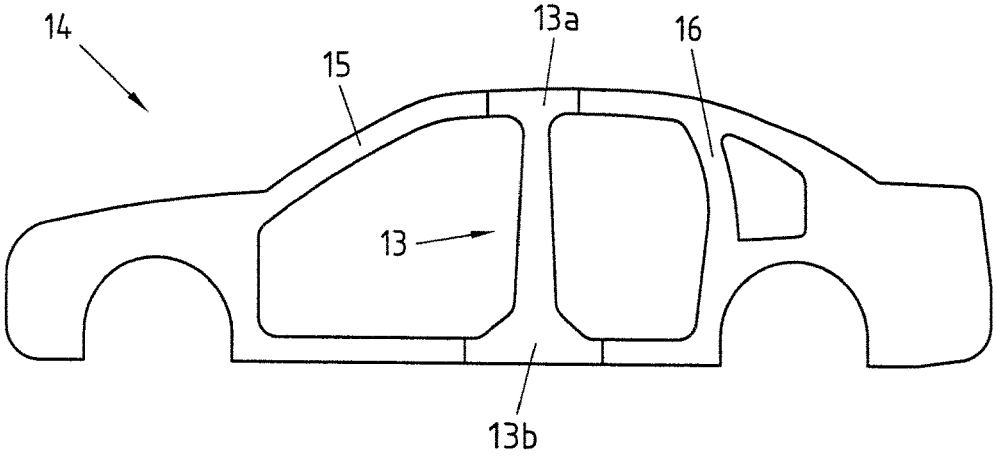
FIGS. 5, 6 and 7 show exemplary embodiments of advantageous uses of a correspondingly produced sheet-metal part.
Figure 6:
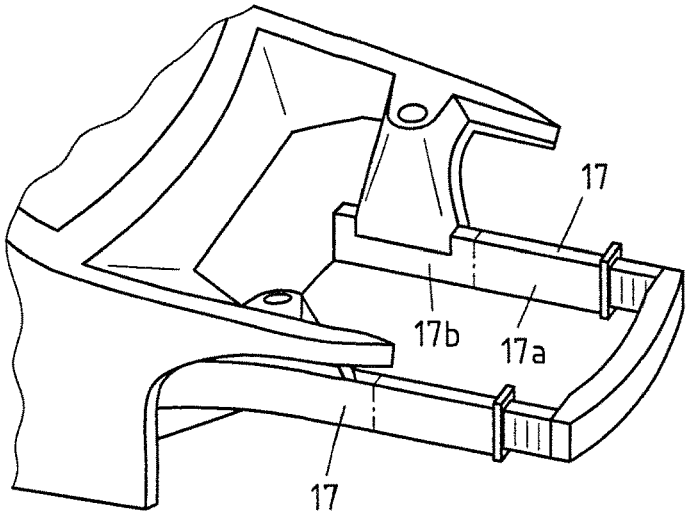
Figure 7:
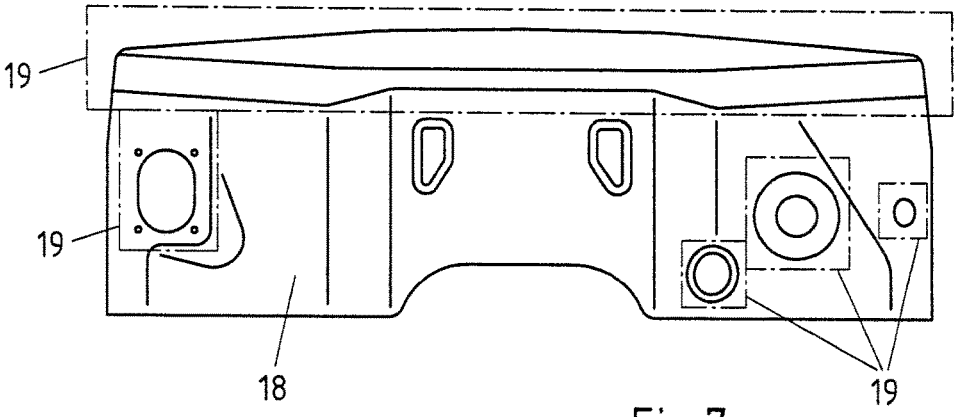

FIGS. 5, 6 and 7 show typical exemplary embodiments of advantageous uses of the shaped sheet-metal part 1. In FIG. 5, by way of example, the use of the sheet-metal part as a B-pillar 13 of a motor vehicle 14 is represented schematically. The B-pillar 13 should preferably comprise a roof connection region 13*b* provided with a high yield point and tensile strength, and a pillar base 13*a* provided with a lower strength but with a greater elongation at break. With the method according to the invention, this B-pillar can be produced economically by the upper region of the B-pillar 13 being strongly cooled in the forming tool and subsequently shaped. In this way, a higher yield point and tensile strength are imparted to the upper region compared with the pillar base 13*a*. The same also applies in principle for the other pillars, the A-pillar 15 represented and the C-pillar 16.

FIG. 6 shows two longitudinal beams of a motor vehicle bodywork, which comprise two different functions in one component. The longitudinal beam 17 is used on the one hand, in the event of impact, first to absorb the impact energy and deform at least partially, and on the other hand to protect the passenger compartment located in the rear region against further deformation. To this end, the longitudinal beams 17 are conventionally configured in such a way that the front region is more easily deformable and the rear region is formed as rigidly as possible. With the method according to the invention, it is now possible to produce a longitudinal beam 17 in such a way that its front region 17*a* has a lower strength than the rear region 17*b*, the rear region of the longitudinal beam 17*b* being strongly cooled in the forming tool. The effect achieved by this is that the yield points and the tensile strengths of the two regions differ significantly. In the part of the longitudinal beam 17 provided with a higher yield point, for example, as likewise in the other uses above, a yield point of more than 800 MPa is provided so that this region is formed particularly solidly. The region 17*a*, on the other hand, is formed softly in the same process, as this region of the forming tool is not thermally regulated. The use of possible tailored blanks, which require additional working step in order to provide a similar strength profile, can therefore be avoided.

Lastly, FIG. 7 shows an example of an end wall 18, which is also preferably produced by the method according to the invention. The end wall 18 generally has a large area and has a relatively small thickness. Individual connection regions 19 are formed for example with a higher yield point and tensile strength, so that no reinforcements in the form of patches, tailored blanks or separate components are any longer necessary. Furthermore, the effects achievable by controlled thermal regulation of the forming tool are not only that specific regions of the end wall 18 exhibit significantly different deformation behaviour in the event of an impact, but also that local regions, which are used to accommodate equipment, for example brake boosters, air conditioning, etc., are provided with corresponding yield points and tensile strengths so that the end wall 18 can be configured load-compliantly without additional measures.

In the typical uses of the sheet-metal part shaped according to the invention, as represented in FIGS. 5 to 7, it is readily possible in particular to provide cathodic corrosion protection on the basis of a surface coating containing zinc and/or an organic surface coating, since hot forming can be avoided.

The invention claimed is:

1. A method for producing a shaped sheet-metal part from a panel or a semifinished part made of a material comprising of steel with at least 60 wt. % Fe and a residual austenite content of at least 5%, comprising a cooling step in which the panel or the semifinished part is at least partially cooled to a temperature below −20° C. prior to a shaping step and comprising a shaping step in which the panel or the semifinished part is shaped at said temperature below −20° C. in a forming tool, wherein reduction of the material temperature of the panel or the semifinished part to below −20° C. is carried out in a thermally regulated cooling apparatus.

2. The method according to claim 1, wherein the panel or the semifinished part is removed from the cooling apparatus and delivered to the forming tool immediately before the shaping process.

3. The method according to claim 1, wherein the forming tool, in which the panel or the semifinished part is cooled and subsequently shaped, is used as the cooling apparatus.

4. The method according to claim 3, wherein icing of the forming tool, and the panel and/or the semifinished part, is prevented by using deicing means before and during the shaping.

5. The method according to claim 1, wherein the panel or a semifinished part comprises a surface coating.

6. The method according to claim 5, wherein the surface coating contains zinc.

7. The method according to claim 1, the method further comprising producing a structural part from the sheet metal part such that it has regions with different strengths and incorporating the structural part into a motor vehicle.

8. The method according to claim 7, wherein the structural part comprises a pillar, support, large-area component, base plate, tunnel, end wall or wheel well of a motor vehicle.

9. The method according to claim 7, wherein the structural part comprises a B-pillar of a motor vehicle, at least one region of the roof connection of the B-pillar having a higher strength than the region of the B-pillar base.

10. The method according to claim 7, wherein the structural part comprises a longitudinal beam in the front region of a motor vehicle, and the longitudinal beam comprises a front region which has a lower strength than the rear region.

11. A method for producing a shaped sheet-metal part from a panel or a semifinished part made of a material comprising of steel with at least 60 wt. % Fe and a residual austenite content of at least 5%, comprising a cooling step in which the panel or the semifinished part is at least partially cooled to a temperature below −20° C. prior to a shaping step and comprising a shaping step in which the panel or the semifinished part is shaped at said temperature below −20° C. in a forming tool, wherein reduction of the material temperature of the panel or the semifinished part to below −20° C. is carried out in a thermally regulated cooling apparatus;

wherein the forming tool, in which the panel or the semifinished part is cooled and subsequently shaped, is used as the cooling apparatus; and wherein the forming tool thermally regulates the panel to be shaped, or the semifinished part to be shaped, only in the regions in which a high yield point and tensile strength are required.

12. The method according to claim 11, wherein the wall thickness of the panel or of the semifinished part is from 0.5 mm to 1.80 mm.

13. The method according to claim 11, wherein the wall thickness of the panel or of the semifinished part is from 0.7 mm to 1.20 mm.

14. A method for producing a shaped sheet-metal part from a panel or a semifinished part made of a material comprising of steel with at least 60 wt. % Fe and a residual austenite content of at least 5%, comprising a cooling step in which the panel or the semifinished part is at least partially cooled to a temperature below −20° C. prior to a shaping step and comprising a shaping step in which the panel or the semifinished part is shaped at said temperature below −20° C. in a forming tool, wherein reduction of the material temperature of the panel or the semifinished part to below −20° C. is carried out in a thermally regulated cooling apparatus;

wherein the forming tool, in which the panel or the semifinished part is cooled and subsequently shaped, is used as the cooling apparatus; and wherein icing is prevented by using mechanical deicing means and/or by using a protective gas to produce a protective gas atmosphere on the cooled regions.

15. The method according to claim 14, wherein the wall thickness of the panel or of the semifinished part is from 0.5 mm to 1.80 mm.

16. The method according to claim 14, wherein the wall thickness of the panel or of the semifinished part is from 0.7 mm to 1.20 mm.

17. A method for producing a shaped sheet-metal part from a panel or a semifinished part made of a material comprising of steel with at least 60 wt. % Fe and a residual austenite content of at least 5%, comprising a cooling step in which the panel or the semifinished part is at least partially cooled to a temperature below −20° C. prior to a shaping step and comprising a shaping step in which the panel or the semifinished part is shaped at said temperature below −20° C. in a forming tool, wherein reduction of the material temperature of the panel or the semifinished part to below −20° C. is carried out in a thermally regulated cooling apparatus;

wherein the forming tool, in which the panel or the semifinished part is cooled and subsequently shaped, is used as the cooling apparatus; and wherein the cooling of the forming tool, the panel and/or the semifinished part is carried out using a protective gas, the protective gas preferably flowing through flow channels provided in the forming tool.

18. The method according to claim 17, wherein the wall thickness of the panel or of the semifinished part is from 0.5 mm to 1.80 mm.

19. The method according to claim 17, wherein the wall thickness of the panel or of the semifinished part is from 0.7 mm to 1.20 mm.

20. A method for producing a shaped sheet-metal part from a panel or a semifinished part made of a material comprising of steel with at least 60 wt. % Fe and a residual austenite content of at least 5%, comprising a cooling step in which the panel or the semifinished part is at least partially cooled to a temperature below −20° C. prior to a shaping step and comprising a shaping step in which the panel or the semifinished part is shaped at said temperature below −20° C. in a forming tool, wherein reduction of the material temperature of the panel or the semifinished part to below −20° C. is carried out in a thermally regulated cooling apparatus;

wherein the forming tool, in which the panel or the semifinished part is cooled and subsequently shaped, is used as the cooling apparatus; and wherein the wall thickness of the panel or of the semifinished part is from 0.7 mm to 1.20 mm.

* * * * *